US005485883A

United States Patent [19]

Rippetoe et al.

[11] Patent Number: 5,485,883

[45] Date of Patent: Jan. 23, 1996

[54] METHOD AND APPARATUS TO ENHANCE THE RECOVERY OF CRUDE OIL

[75] Inventors: William W. Rippetoe, Bixby; David N. Shroff, Broken Arrow, both of Okla.

[73] Assignee: Universal Enrivonmental Technologies, Inc., Naples, Fla.

[21] Appl. No.: 423,024

[22] Filed: Apr. 17, 1995

[51] Int. Cl.[6] ..... E21B 37/06; E21B 41/02; E21B 43/00

[52] U.S. Cl. ..... 166/369; 166/233; 166/106; 166/370; 166/902; 166/304

[58] Field of Search ..... 166/61, 62, 60, 166/68, 105, 105.6, 105.1, 106, 369, 370, 233, 231, 902

[56] References Cited

U.S. PATENT DOCUMENTS 2,615,114 10/1952 Colby ..... 166/61 X
2,929,451 3/1960 Hurlstone et al. ..... 166/62 X
3,974,878 8/1976 Roeder et al. ..... 166/105.5 X
4,278,549 7/1981 Abrams et al. ..... 210/695
4,789,031 12/1988 Walker ..... 166/369

*Primary Examiner*—Stephen J. Novosad
*Attorney, Agent, or Firm*—Merrill N. Johnson

[57] ABSTRACT

Method and apparatus to facilitate the economical recovery of crude oil from an oil well having a string of tubing which extends to the level of the underground reservoir of crude oil. An Ion Collider is attached to the lower end of the tubing with the Ion Collider at the level of the crude oil reservoir. The Ion Collider consists of two spaced-apart cylindrical metal tubes whose common vertical axis coincides with the axis of the string of tubing. The Ion Collider's inner tube has its upper end capped and its lower end joined to the lower end of the outer tube whose upper end opens into the interior of the tubing. The Ion Collider's inner tube contains a multiplicity of spaced-apart holes in its cylindrical wall. The entire inner tube and the inner surface of the outer tube are made of an alloy of copper and nickel in which the copper comprises at least 80% of the alloy.

6 Claims, 1 Drawing Sheet

METHOD AND APPARATUS TO ENHANCE THE RECOVERY OF CRUDE OIL

FIELD OF THE INVENTION

The present invention pertains to a method and apparatus to facilitate the economical recovery of crude oil.

BACKGROUND OF THE INVENTION

We are the inventors of a device which we have named the Ion Collider™ on which we filed a patent application Ser. No. 08/350,849 in the U.S. Patent and Trademark Office on Dec. 7, 1994. On Jan. 27, 1995 our assignee Universal Environmental Technologies Inc. filed a patent application under the provisions of the Patent Cooperation Treaty directed to the use of an Ion Collider for treating liquids and gases to beneficially alter their physical characteristics.

Oil wells are either "flowing" wells or wells that require a "down hole" pump to bring the crude oil to the wellhead. Flowing wells flow because the underground reservoir of oil and gas is under sufficient pressure to force the crude oil up the well's string of tubing to the wellhead. In wells without sufficient reservoir pressure to flow naturally, it is common practice to lower an electric or mechanical pump "down hole" to the reservoir of crude and pump the oil up the tubing string to the wellhead.

Many oil wells, both flowing and those served by a "down hole" pump, are plagued with slow flow, clogging and expensive periodic maintenance of the well caused by deposits of paraffins and other waxes carried in most crudes. These paraffins and other waxes tend to deposit on the walls of the tubing and when a "down hole" pump is used, on the pump and pump rods to slow or even stop the flow of crude to the surface. To restore proper recovery of the crude, it has been necessary to cease operation and pull the pump and rods for cleaning or resort to frequent expensive "hot oiling" or chemical treatment of the well.

One method of reducing the harmful deposit of paraffins which has had some success is described in Walker U.S. Pat. No. 4,789,031. Walker screws a gas anchor onto the suction end of the "down hole" pump. Walker's gas anchor is made of a crystalline alloy of specified percentages of certain named metals and its construction forces crude oil being drawn into the pump to first flow through a chamber within the gas anchor. Walker says that use of his gas anchor significantly reduces corrosion of pump parts, rods and the tubing string. Tests run on several wells in Liberty County, Texas located above reservoirs of crude oil about 9,000 feet beneath the wellhead showed that use of Walker's gas anchor reduced but did not eliminate the harmful deposit of paraffins.

SUMMARY OF THE INVENTION

In brief, the invention comprises the use of a specially designed Ion Collider™ attached to the tubing string of an oil well or alternatively in place of Walker's gas anchor beneath a "down hole" pump in an oil well. The Ion Collider for use "down hole" comprises two spaced apart cylindrical metal tubes having a common vertical axis. Both tubes may be made of a pure copper-nickel alloy or preferably the outer tube is made of a ferrous metal and its inner surface flame coated or electrostaticly plated with pure copper-nickel alloy.

The wall of the innermost tube contains a multiplicity of spaced apart radially bored holes and its upper end is capped. The opposite or lower end of the inner tube is joined to the lower end of the outer tube so that the only entry into the Ion Collider is through the lower end of the inner tube and the only exit from the Ion Collider is the upper or exit end of the outer tube. The elongated annular chamber between the inner and outer tubes bounded by copper-nickel surfaces becomes an electron exchange chamber when crude oil under pressure is fed into the chamber. The upper end of its outer tube is threaded so that the Ion Collider can be screwed onto the suction end of a "down hole" pump or screwed into the lower end of the tubing string of a flowing well.

When the well is flowing or the pump is operating, crude oil is sucked up through the open lower end of the Ion Collier's inner tube by pressure into the inner tube causing a multiplicity of streams or jets of crude oil to issue from the radially bored holes in the wall of the inner tube to bombard the copper-nickel walls of the annular chamber between the two tubes. Electrons freed from the copper in the walls of the chamber combine with molecules of the crude oil itself as well as with molecules of the paraffins and other ingredients entrained in the crude oil, thereby altering certain physical characteristics of the crude oil and produced water, if any, and of the other entrained ingredients.

The crude oil and its entrained ingredients treated in the Ion Collider as above described passes through the string of tubing to the surface. The treated crude oil not only is free of paraffins and other waxes which tend to clog the tubing but the Ion Collider breaks up the long chain hydrocarbon molecules, making the oil "slicker" and less capable of transporting suspended solids. On high paraffin, low gravity crudes, the treatment increases the American Petroleum Institute specific gravity of the resulting crude by at least two or three points thus increasing the marketability of these types of treated crude oil.

BRIEF DESCRIPTION OF THE DRAWINGS

The appended drawings illustrate the invention and are intended to supplement the description of the invention in the text of this application.

DETAILED DESCRIPTION OF THE PREFERRED EMBODIMENTS

Figure 3:
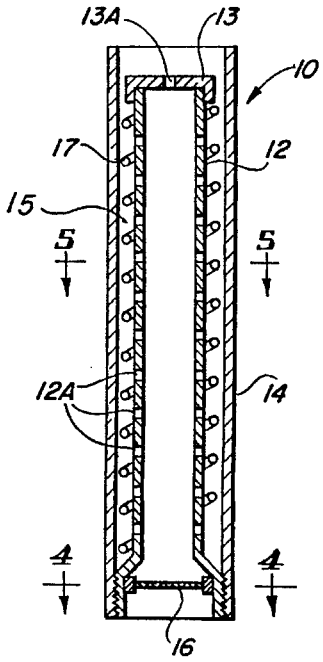
FIG. 3 is a cross sectional elevational view taken though the center of the Ion Collider of FIGS. 1 and 2.

Referring first to FIG. 3, Ion Collider 10 consists of two spaced apart concentric elongated cylindrical metal tubes 12 and 14. Each tube may be made of copper-nickel alloy or preferably the outer tube 14 is made of ferrous metal with its inner surface flame coated or electrostaticly plated with an alloy containing 90% copper and 10% nickel.

Figure 4:
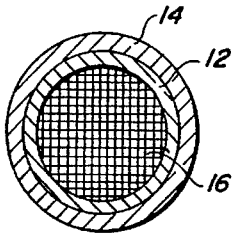
FIG. 4 is a cross sectional end view taken along line 4—4 of FIG. 3.

The wall of inner tube 12 contains a multiplicity of spaced apart radially bored holes 12A and its exit end is closed by a cap 13 which may have a hole 13A in the center of the cap. The entry end of tube 12 is joined to outer tube 14 as shown in FIG. 3 and a filter screen 16 of copper mesh as shown in FIGS. 3 and 4 is fitted over the entry end of tube 12 to prevent intrusion of unwanted solid particles into Ion Collider 10. The upper or exit end of outer tube 14 is threaded in order to screw Ion Collider 10 onto the entry end of a "down hole" pump or to the lower end of the tubing string of a flowing well.

Both tubes 12 and 14 may be made of a copper-nickel alloy in which nickel comprises at least 1% and copper comprises at least 80% of the composition of the pipes. Preferably tube 14 is made of black iron and the inner surface of tube 14 flame coated with a copper-nickel alloy containing about 10% nickel and 90% copper.

For best results the sum of the cross-sectional areas of the multiplicity of radially bored holes 12A should equal or preferably be 1.2 times the cross-sectional area of inner tube 12 in order to prevent any back pressure or flow restriction during operation of the Ion Collider. Moreover, the velocity of the jets of crude oil as they exit from holes 12A should be at least 0.025 feet per second. The formula for computing the jet velocity in feet per second of the oil exiting from holes 12A is 4085 times the gallons per minute divided by the square of the diameter of holes 12A.

Figure 5:
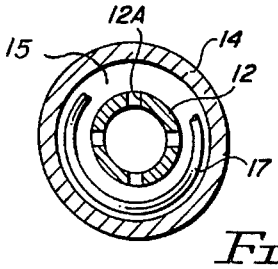
FIG. 5 is a cross sectional end view taken along line 5—5 of FIG. 3.

Ion Collider 10 includes an elongated annular chamber 15 whose surfaces consist of copper-nickel alloy which acts as an electron exchange chamber between tubes 12 and 14 as best shown in FIG. 3. To increase turbulence and provide more contact surface area in chamber 15, a helix of copper or copper-nickel wire 17 is loosely wrapped around the length of the outer surface of inner tube 12 as shown in FIGS. 3 and 5.

Figure 1:
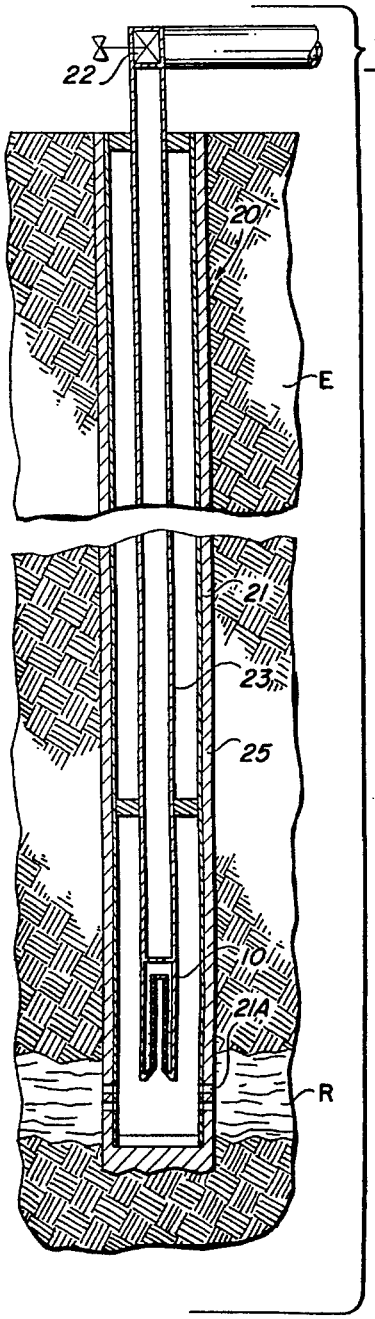
FIG. 1 is a diagrammatic representation of a flowing oil well with an Ion Collier at the lower end of the well's tubing string in accordance with our invention.
Figure 2:
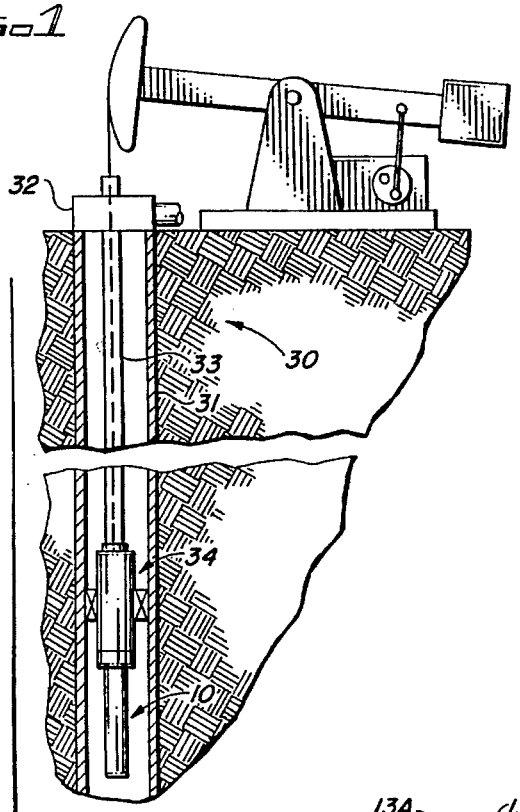
FIG. 2 is a diagrammatic representation of an oil well with a "down hole" pump and an Ion Collider located at the level of the reservoir of crude oil in accordance with our invention.

Turning now to FIGS. 1 and 2 which diagrammatically illustrate respectively the use of our Ion Collider 10 in a flowing well and in a well equipped with a "down hole" mechanical pump.

FIG. 1 illustrates a flowing oil well 20 which reaches from the surface of the earth E to an underground reservoir R of oil and gas. Oil well 20 includes a steel casing 21, a valved wellhead 22, and a string of steel tubing 23. In most oil wells a layer of cement 25 surrounds steel casing 21 as shown in FIG. 1. The casing 21 and cement layer 25 extend from the surface of earth E to beneath reservoir R of oil and gas. In that portion of casing 21 and cement layer 25 which passes through the reservoir of oil and gas there are a plurality of holes 21A through which crude oil flows due to the pressure of the gas in reservoir R into the interior of steel casing 21 and up the string of tubing 23 to wellhead 22 if there is no Ion Collider at the lower end of the tubing 23. As the crude oil and its entrainments flow up the string of tubing, paraffins and other waxes contained in the crude will deposit onto the interior wall of the tubing restricting and slowing the recovery of the crude. In the case of high paraffin crudes, the deposits are often sufficient to stop the flow of crude to the surface.

Our invention contemplates the attachment of Ion Collider 10 to the lower end of the tubing as shown in FIG. 1 to enhance the recovery of the crude oil. When Ion Collider 10 is securely joined to tubing 23, crude oil and its entrainments will flow under pressure from the gas in reservoir R through holes 12A in the casing and through the entry end of inner tube 12 into the tube. Crude and its entrainments will be fed under pressure through the multiplicity of holes 12A as jets to impinge onto the copper-nickel surfaces of annular chamber 15 and the surface of helical wire 17.

Electrons freed from the copper surfaces of chamber 15 and wire 17 will combine with molecules of the crude itself, any water carried by the crude, and the paraffins and other waxes and entrainments carried by the crude, thereby altering certain physical characteristics of the crude, any water carried by the crude, and the paraffins and other entrainments carried by the crude, thus achieving the benefits previously described to enhance the recovery of the crude oil.

FIG. 2 illustrates an oil well 30 which requires a "down hole" mechanical pump 34 to create a flow of oil up the string of tubing 33 to the wellhead 32. The pump is held in strict axial alignment within steel casing 31 by a surrounding annular packing. Ion Collider 10 is firmly screwed onto the suction or lower end of pump 34 positioned so that the lower or entry end of the Ion Collider lies at the level of a reservoir of crude oil. Crude oil is drawn into casing 31 through holes in the casing (not shown) by operation of pump 34.

The crude and its entrainments are sucked into the interior of the Ion Collider's inner tube 12 and expelled from the inner tube's radially drilled holes 12A as jets which impinge upon the copper-nickel walls of the Ion Collider's annular chamber 15 and wire 17 exactly as previously described in reference to the flowing oil well 20 illustrated in FIG. 1.

The treated crude oil will be free of paraffins and other waxes which would otherwise clog the tubing and impede or block the upward flow of crude oil. The Ion Collider also breaks up long chain hydrocarbon molecules, making the oil less capable of transporting suspended solids.

While we have illustrated and described in detail two preferred embodiments of our invention, such description should not be taken as defining the scope or our invention. The scope of our invention is limited only by the appended claims.

We claim:

1. Apparatus for enhancing the recovery of crude oil from an oil well having a string of tubing in the well which extends to the level of the underground reservoir of crude oil comprising a device attached to the lower end of the tubing in the oil well and positioned so that the device lies at the level of the reservoir of crude oil, said device consisting of two spaced apart cylindrical metal tubes having a common vertical axis, the innermost cylindrical tube having an open lower end, a capped upper end and a multiplicity of radially bored spaced apart holes in the wall of the inner tube, the outer cylindrical tube having its lower end joined to the lower end of the inner tube and its upper end remaining open, the inner tube being made of an alloy of pure copper and pure nickel in which the copper comprises at least 80% of the alloy, and the outer tube having its entire interior surface made of an alloy of pure copper and pure nickel in which the copper comprises at least 80% of the alloy.

2. Apparatus to enhance the recovery of crude oil from an oil well having a string of tubing in the well extending to the level of the underground reservoir of crude oil comprising a pump attached to the lower end of the tubing with its suction opening facing downward, a device positioned beneath the suction opening of the pump, said device comprising two spaced apart cylindrical metal tubes having a common vertical axis, the innermost cylindrical tube having an open lower end, a capped upper end and a multiplicity of radially bored spaced apart holes in the wall of the inner tube, the outer cylindrical tube having its lower end joined to the lower end of the inner tube and having its upper end remaining open, the inner tube being made of an alloy of pure copper and pure nickel in which the copper comprises at least 80% of the alloy, the outer tube having its entire interior surface made of an alloy of pure copper and pure nickel in which the copper comprises at least 80% of the alloy, and means for securely joining the upper end of the outer tube of the device to the suction opening of the pump.

3. A method of enhancing the recovery of crude oil from an oil well having a string of tubing in the well which extends to the level of the underground reservoir of crude oil comprising attaching a device to the lower end of the tubing in the oil well, said device consisting of two spaced apart cylindrical metal tubes having a common vertical axis, the innermost cylindrical tube having an open lower end, a capped upper end and a multiplicity of radially bored spaced apart holes in the wall of the inner tube, the outer tube having its lower end joined to the lower end of the inner tube and its upper end remaining open, the inner tube being made of an alloy of pure copper and pure nickel in which the copper comprises at least 80% of the alloy, the outer tube having its entire interior surface made of an alloy of pure copper and pure nickel in which the copper comprises at lest 80% of the alloy, and using the oil reservoir pressure to draw the crude oil into the open lower end of the device and into the interior of the inner tube causing a multiplicity of streams or jets of crude oil to issue from the radially bored holes in the wall of the innermost tube to bombard the copper and nickel walls of the annular chamber between the two tubes of the device whereby electrons freed from the copper in the walls of the chamber combine with molecules of the crude oil itself and with the molecules of the paraffins and other ingredients entrained in the crude oil to alter certain physical characteristics of the crude oil and its entrained ingredients.

4. A method of enhancing the recovery of crude oil from an oil well having a string of tubing which extends to the level of the underground reservoir of crude oil comprising attaching a pump to the lower end of the string of tubing in the oil well with its suction opening facing downward, joining a device to the suction opening of the pump with the entry end of the inner tube of the device facing downwards, said device consisting of two spaced apart tubes having a common vertical axis, the innermost tube having an entry lower end, a capped upper end and a multiplicity of space apart radially bored holes in the wall of the tube, the outer tube having its lower end joined to the lower end of the inner tube and an open upper end, and the outer wall of the inner tube and the inner wall of the outer tube being made of an alloy of pure copper and pure nickel in which the copper comprises at least 80% of the alloy, and operating the pump to draw crude oil from the reservoir into the interior of the inner tube of the device causing a multiplicity of streams or jets of crude oil to issue from the radially bored holes in the wall of the inner tube to bombard the copper and nickel walls of the annular chamber between the two tubes of the device whereby electrons freed from the copper walls of the annular chamber combine with molecules of the crude oil itself and with molecules of the paraffins and other ingredients entrained in the crude oil to alter certain physical characteristics of the crude oil and its entrained ingredients.

5. Apparatus for enhancing the recovery of crude oil from an oil well as set forth in claim 1 in which a helix of copper-nickel wire is loosely wound around the length of the inner tube of the device.

6. Apparatus to enhance the recovery of crude oil from an oil well as set forth in claim 2 in which a helix of copper-nickel wire is loosely wound around the length of the inner tube on the device.

* * * * *